United States Patent [19]

Janoski

[11] 3,941,056

[45] Mar. 2, 1976

[54] BLASTING CAP ADAPTER FOR SEVERING BLASTING CIRCUIT LEADS

[75] Inventor: Florian B. Janoski, Allentown, Pa.

[73] Assignee: Atlas Powder Company, Wilmington, Del.

[22] Filed: June 18, 1974

[21] Appl. No.: 480,379

[52] U.S. Cl. ..... 102/22; 102/28 R
[51] Int. Cl.[2] ..... F42B 19/12
[58] Field of Search ..... 102/22, 24, 28, 29

[56] References Cited

UNITED STATES PATENTS

| | | | |
|---|---|---|---|
| 1,293,354 | 2/1919 | Cunningham | 102/29 |
| 2,407,442 | 9/1946 | Parr, Jr. | 102/22 |
| 2,823,610 | 2/1958 | Frazer | 102/28 |
| 3,021,785 | 2/1962 | Hradel et al. | 102/24 |

*Primary Examiner*—Verlin R. Pendegrass
*Attorney, Agent, or Firm*—Connolly and Hutz

[57] ABSTRACT

An adapter, for attachment to electric blasting circuit leads to an explosive charge, houses an electric blasting cap connected with the blasting circuit for severing the leads immediately after the blast is fired. The adapter comprises a tube which supports the cap and which has a slot cut into and through the tube wall adjacent the explosion end of the supported cap by which the tube is attached to the blasting circuit leads.

7 Claims, 12 Drawing Figures

Fig.3.
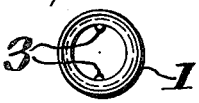
Fig.1.
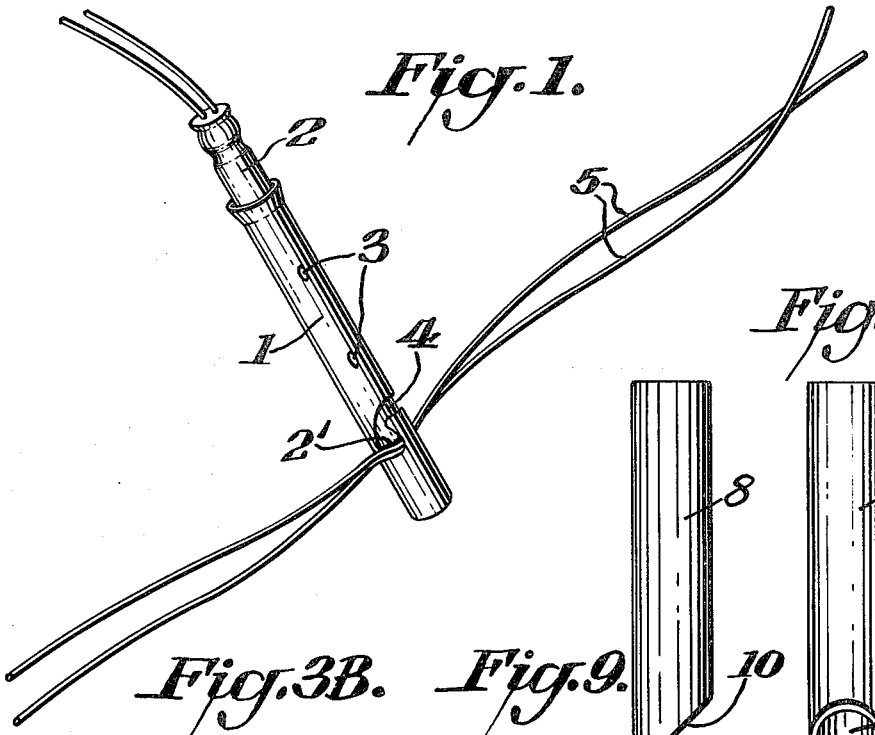
Fig.2.
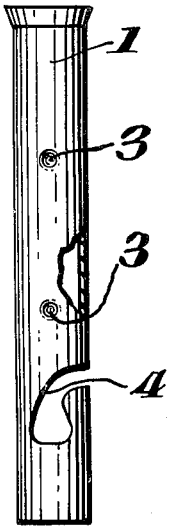
Fig.8.
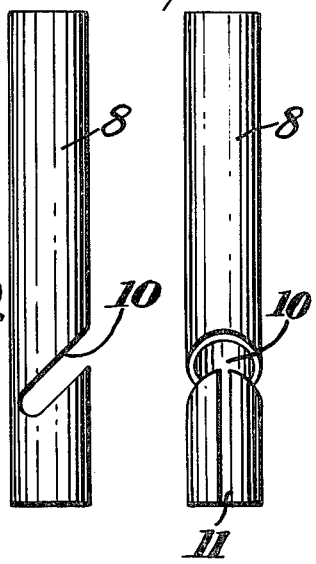
Fig.3B.
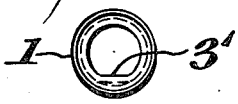
Fig.9.
Fig.3A.
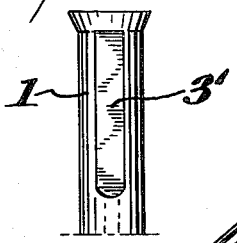
Fig.4.
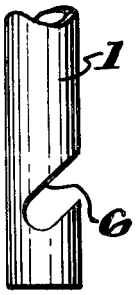
Fig.6.
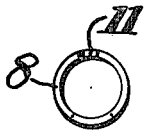
Fig.10.
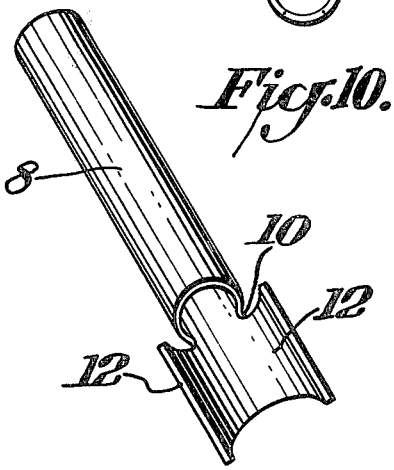
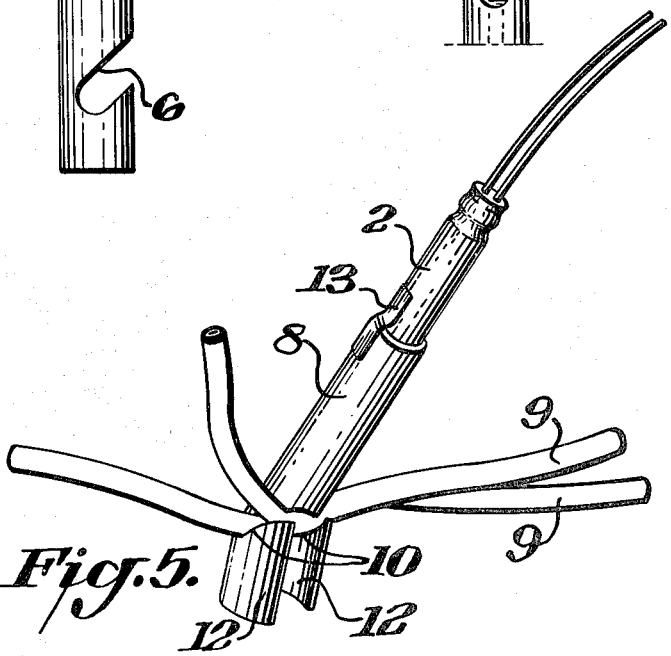
Fig.5.
Fig.7.
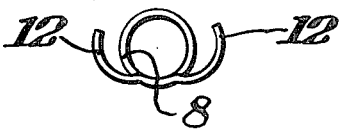

BLASTING CAP ADAPTER FOR SEVERING BLASTING CIRCUIT LEADS

BACKGROUND OF INVENTION

Blasting circuit wiring includes the firing or leading lines, any interconnecting wire and the legwires which are attached to the electric blasting caps. All may be properly connected to form an appropriate electric blasting circuit. To fire the blast an initiating current is introduced into the circuit from a firing source such as a capacitor discharge blasting device or any other approved source of electrical power.

The adapter of this invention is intended to act as a safety device for use when blasting near high voltage transmission lines.

The adapter may also be employed as a fast-acting circuit severer to interrupt electric current in configurations of electric blasting circuitry in which hazards to personnel could exist as the result of arcing malfunctions.

In commercial electric blasting near high voltage transmission lines the main hazard to personnel lies in the danger of suffering burns or electrocution if a blasting circuit wire is thrown into contact with an energized power line. One of the precautionary measures in use involves taping an explosive charge or detonating cord to the firing line to be severed. The explosive so taped is initiated by a millisecond delay electric blasting cap which is properly connected and electrically part of the electric blasting circuit. A typical millisecond delay electric blasting cap to be used in this application is the Atlas Rockmaster 1 which will detonate in about 8 milliseconds after the electrical current from a blasting machine is supplied to the blasting circuit. The detonation of the blasting cap initiates the explosive charge which severs the electrical firing lines which lead back to the terminals of the blasting machine. This prompt severing of the firing lines at some safe distance from the overhead transmission lines will insure that the person operating the blasting machine will not be electrically connected to the high voltage lines in the event that a wire of the blasting circuit is flung into contact with the power lines by force of the blast.

With the adapters disclosed in this invention the need for an explosive charge, in addition to an appropriate millisecond delay blasting cap, is eliminated. Instead, the line-severing adapter is affixed to the lines to be separated and the appropriate millisecond delay blasting cap is inserted into the adapter. When the firing current is applied to the blasting circuit the millisecond delay cap will function after the short delay interval to sever the firing lines before any other circuit wiring could reach the overhead lines.

In shaft sinking and tunnel driving operations a blasting circuit of electric blasting caps connected in parallel or reverse parallel electric configuration is widely preferred. These circuits are most often energized by current switched to the circuit directly from a 220 or 440 volt power line. A wide range of delayed periods extending to 7½ seconds, and beyond, are often used in the parallel circuit to achieve the desired sequence of rock-throwing in a given blast. If the power line firing switch is closed to energize the blasting circuit, the continued application of current to the circuit could result in electric arcing within the caps. This arcing, with the attendant generation of intense heat, can cause arcing malfunctioning, that is, rupture of the cap, blowout of the cap sealing plug, expansion of the cap body with flame bypassing the delay element or accelerated burning of the pyrotechnic delay mixture.

Any of these effects can result in seriously erratic delay timing. Some can cause an extinguishing of the burning delay mixtures. Others can produce a premature detonation of the explosive in which the cap is embedded. A most serious effect results when the cap fails to detonate and the intense arc ignites the explosive to cause a slow burning "hangfire." This latter effect has been known to result in blasts taking place up to a half hour after the main blast took place which of course presents a hazard to personnel reentering the area.

To prevent an arcing malfunction the firing line severing adapater of the present invention would be affixed to one of the two firing lines, preferably to one of the temporary firing lines near the blast site. An appropriate delay cap, such as an Atlas Rockmaster 2 would be inserted into the adapter to sever the firing line approximately 25 milliseconds after the current was applied to the blasting circuit. As a doubly safe measure, a line severing adapter could be affixed to each of the two firing lines, just ahead of the main blasting circuit at the blasting site.

Other lead severing arrangements are known which act to sever the blasting circuit leads through the explosive force emanating from a blast hole. Such devices are illustrated by the Parr U.S. Pat. No. 2,607,442 issued in 1946. In addition, deflecting or catching devices are known which operate to prevent cap wires from flying into contact with high voltage transmission lines, personnel or other electrical operating equipment. Such a deflection device is illustrated by the Rodriquez U.S. Pat. No. 3,339,486 issued in 1967.

Also it is known to use fast acting electrical circuit breakers between the firing switch and the blasting circuit firing line in the parallel or reverse parallel electrical configuration described above in shaft-sinking and tunnel-driving operations.

SUMMARY OF THE INVENTION

The invention relates to an adapter which houses a millisecond delay blasting cap of a type well known to the blasting profession. The adapter is in the shape of a tube designed in a manner which directs the blast effect of the detonating portion of the cap to the wire or wires to be severed. A slot is formed in and through the tube wall adjacent the inserted end of the cap which supports the leading lines to the electric blasting caps in the main explosive charges. The explosive end of the cap seats on the lead lines laced through the slot to prevent the lines from sliding out of the slot.

For supporting heavier gauge circuit leads the wall of the tube below the slot can be split and the split portions flared outwardly. Here, the upper portion of the tube is then bent downwardly toward the flared portions to clamp the wires in place between the upper and lower tube portions.

DETAILS OF THE INVENTION

FIGS. 1–4 of the drawing illustrate the form of adapter which can be used with the thinner gauge wires while FIGS. 5–10 illustrate an embodiment which is preferably used with wires of thicker gauge.

FIG. 1 is a perspective of the adapter with the circuit wires and blasting cap incorporated therewith.

FIG. 2 is a side elevation partially broken away of the adapter of FIG. 1.

FIG. 3 is an end view of the adapter of FIG. 2

FIG. 3A is a detail showing a modification of the adapter of FIGS. 1–3.

FIG. 3B is an end view of the modified adapter of FIG. 3A.

FIG. 4 is a detail of the tube of FIGS. 1–3 showing a modified slot for holding the blasting leads.

FIG. 5 is a perspective of an adapter used with thicker lead wires and shows the cap and wire in place.

FIG. 6 is a perspective of the adapter tube shown in FIG. 5 taken from a different angle.

FIG. 7 is an end view of the adapter tube of FIGS. 5 and 6 taken from the slotted end of the tube.

FIG. 8 is a side elevation of the adapter tube of FIGS. 5–7 prior to flaring or spreading the split ends of the tube adjacent the slotted end of the tube.

FIG. 9 is a side elevation of the adapter tube of FIG. 8 with the tube rotated 90° to the right; and FIG. 10 is an end view of the adapter tube shown in FIGS. 8 and 9.

The materials from which the adapter for the thinner lead wires as shown in FIGS. 1–4 can be made include a variety of metals and plastics. For instance, gilding metal is a satisfactory material from which the adapter can be fashioned, however, a thin steel tube is preferred both from the standpoint of ease of handling and machining and since it provides an extra measure of safety in achieving positive severing of the lead lines.

The adapter tube which is used with the heavier gauge wires as shown in FIGS. 5–10 has a thicker wall and is preferably made from wrought iron, seam welded tubing or other similar material.

As shown in FIGS. 1–3 of the drawings the metal tube 1 supports a blasting cap 2 inserted in one end thereof. Inwardly extending peen mark protrusions 3 in the cap insert end of the tube 1 hold the cap 2 in place within the adapter tube 1 so that it cannot slide out of the tube. Instead of the peen mark protrusions, a flat surface 3′ can be indented in the tube wall as shown in FIGS. 3A and 3B.

The opposite end of the tube is machined to form a slot 4 through which are laced the blasting circuit leading lines 5. The explosive end of the cap 2′ seats upon the leads to hold them firmly within the slot.

The slot 4 of FIGS. 1–3 has an irregular curved outline as shown better in FIG. 2. An embodiment of the slot which can also be used with the adapter tube 1 is shown in FIG. 4. Here, the slot 6 is of a generally U-shaped outline.

A modification of the adapter tube which is used with heavier gauge blasting circuit leads is illustrated in FIGS. 5-10. Here the adapter tube 8 supports the blasting cap 1 with the blasting lead lines 9 supported in a slot 10 wherein that portion of the tube beyond the slot 10 and extending away from the cap insert end of the tube has been split longitudinally at 11 as shown better in FIGS. 8–10 and the split portions have been spread or flared to form ears 12, 12 as shown in FIGS. 5–7.

The blasting circuit wires to be severed are wedged in place within the slot 10 by inserting the leads 9, 9 within the slot and then bending the portions of the tube 8 on either side of the slot toward each other which clamps the leads in place. This is done prior to insertion of the blasting cap.

With the arrangement shown in FIGS. 5–10 wherein no inwardly extending peen or flat surface arrangement is used in the tube wall in view of the thicker wall, the cap 2 can be held in place within the tube 8 by a strip of adhesive tape 13 extending along the longitudional axis of the tube as shown better in FIG. 5. The tape strip can also be applied circumferentially of the tube and cap. The inwardly extending peens or flat surfaces used with the thinner walled tubes as shown in FIGS. 1–4 can also be eliminated, if desired, and tape strips 13 can be used as described above to hold the cap in place within the tube. Any of the above means for securing the cap in the adapter cooperates with the seating action of the cap against the leads to grip the wires and hold them within the slot. This is true for both embodiments, however, the clamping action achieved with the heavier walled embodiments also serves to hold the leads in place.

The adapter shown in FIGS. 1–4 is preferably used for severing firing lines which are of 20 gauge or lighter and which are formed of insulation-coated copper, copper-clad aluminum, aluminum, copper-clad iron or iron wire. The embodiment shown in FIGS. 5–11 is used with the heavier gauge wires up to and including No. 14 AWG with insulation coating.

Another important benefit of the present invention derives from the fact that when the wires are severed they are thrown apart. This separation of the wires provides a gap between the severed ends to give a high degree of insurance against accidental recontacting of the severed ends.

With the above adapter a No. 6 strength blasting cap can be used for severing both the thinner and thicker gauge blasting circuit leads.

What is claimed is:

1. An assembly for attachment to the circuit leads for a primary explosive charge for severing the circuit leads immediately after the primary charge circuit has been energized comprising a tube, a millisecond delay blasting cap inserted in said tube, said cap having its own leg wires connected to the primary charge circuit, means cooperating with the tube wall and the cap for retaining the cap firmly in place within the tube, a slot extending through the tube wall transversely of the longitudinal axis of the tube, which slot receives the primary explosive charge circuit leads for attaching the assembly to said leads.

2. The assembly of claim 1 wherein the slot in the tube wall is formed by a curved cutout portion of the tube wall.

3. The assembly of claim 1 wherein the cap retaining means consists of indented areas in the tube wall.

4. The assembly of claim 1 wherein the slot is located in that end of the tube wall opposite the end in which the cap is inserted at such a point that the inserted end of the cap will seat upon the primary charge circuit when threaded through the slot.

5. The assembly of claim 1 wherein the portion of the tube on the side of the slot opposite the cap insert end of the tube is split longitudinally and the split portions are flared horizontally to form protruding ears.

6. The assembly of claim 5 wherein the portions of the tube on both sides of the slot are bent toward one another to clamp the leads within the slot.

7. The assembly of claim 1 wherein the cap retaining means consists of at least one strip of adhesive tape.

* * * * *